US006388679B1

(12) United States Patent
Kluck et al.

(10) Patent No.: US 6,388,679 B1
(45) Date of Patent: May 14, 2002

(54) MULTI-RESOLUTION COMPUTER DISPLAY SYSTEM

(75) Inventors: Joseph R. Kluck, Portland; William J. Nerenberg, Hillsboro; David E. Dent, Portland; Sanjay V. Vora, Hillsboro; Paul M. Cohen, Beaverton, all of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/222,406

(22) Filed: Dec. 29, 1998

(51) Int. Cl.[7] ..... G09G 5/00
(52) U.S. Cl. ..... 345/698; 345/781; 345/788
(58) Field of Search ..... 345/340, 132, 345/127, 428, 342, 522, 526, 503, 698, 781, 788

(56) References Cited

U.S. PATENT DOCUMENTS 5,083,210 A * 1/1992 Reilly et al. ..... 358/298
5,282,057 A * 1/1994 Mailloux et al. ..... 358/445
5,415,548 A * 5/1995 Adams ..... 345/114
5,446,831 A * 8/1995 Yamashita et al. ..... 395/102
5,579,445 A * 11/1996 Loce et al. ..... 395/102
5,920,327 A * 7/1999 Seidensticker, Jr. ..... 345/523
6,081,265 A * 6/2000 Nakayama et al. ..... 345/329
6,115,054 A * 9/2000 Giles ..... 345/522

* cited by examiner

*Primary Examiner*—Raymond J. Bayerl
*Assistant Examiner*—Cuong T. Thai
(74) *Attorney, Agent, or Firm*—Kenyon & Kenyon

(57) ABSTRACT

A method and apparatus are provided for the simultaneous display of different "viewing areas" on a computer video display monitor so that a user sees them as displayed at different resolutions. When a user selects a resolution for a viewing area different from the background resolution of the rest of the video display monitor, the background resolution of the display monitor is set as the highest resolution at which data is to be displayed. High-level graphics commands are intercepted by a multi-resolution system mimicking a display driver. High-level graphics commands are interpolated using a resolution conversion ratio. Modified high-level graphics commands are sent to the true display driver and an image is displayed at an apparent resolution lower than the background resolution. This enables a user to optimize the display of computer data depending on the program outputting that data and the user's requirements.

12 Claims, 8 Drawing Sheets

MULTI-RESOLUTION COMPUTER DISPLAY SYSTEM

BACKGROUND OF THE INVENTION

The present invention pertains to a system for display of computer data. More specifically, a system is provided for simultaneously displaying different groups of computer data on a display screen at different resolutions.

Computer data is displayed on display screens of computer monitors. A computer monitor screen contains dots which are illuminated in patterns to form images (letters, numbers, pictures, and other graphics). The dot is the smallest physical unit which makes up a computer graphics image and on certain video display screens consists of a dot of phosphorous on the screen. These phosphorous dots give off light when bombarded with electrons from a cathode ray tube.

A pixel is a picture element and, from the perspective of computer software that outputs display data, it is the smallest element of a graphics image. The display data and commands output by a software program are processed by a display driver and output as graphics data to a graphics controller, which controls the display of each pixel on the screen. Each pixel may comprise several dots, or even a single dot, as in very robust display systems. The number of pixels capable of being displayed by the fixed number of dots on a screen is the resolution of the screen. The screen resolution, therefore, represents both the number of pixels capable of being displayed on the screen, and the number of dots in each pixel. The lower the resolution, the more dots per pixel, and the larger each pixel appears. The higher the resolution, therefore, the lower the number of dots per pixel, and the smaller each individual pixel appears. Program outputs or image files formatted for higher resolutions contain more pixels and therefore, more memory is required to store the images.

While the number of dots on an entire display screen is fixed, the number of pixels on the screen can often be adjusted, thereby adjusting the resolution. This is a feature of, for example, the Microsoft Windows® 95 operating system in which the user can adjust the number of pixels to be displayed on the screen (e.g. 640 pixels×480 pixels, 800 pixels×600 pixels, 1024×768 pixels). By changing the number of pixels displayed, the user is also changing the number of dots per pixel. The more pixels displayed on the screen, the fewer dots per pixel, and the higher the resolution of the images on the screen. Higher resolution images appear "sharper" to the user because the eye is less able to distinguish the fact that the image is made up of individual pixels due to the smaller pixel size. "Sharpness," therefore, is a description of how an image on the screen appears to a viewer.

By decreasing the number of pixels capable of being displayed on the screen (decreasing resolution), the number of dots per pixel is increased, and the sharpness of the images on the screen is decreased. By increasing the number of dots per pixel, decreasing the resolution not only decreases the sharpness of the images, but it also increases the size of the images on the screen. Conversely, decreasing the dots per pixel (increasing the resolution) increases sharpness and decreases the size of the image. There exists, therefore, an image size, sharpness tradeoff. High resolution corresponds to small image size, with more information able to be displayed on the screen. Low resolution corresponds to large image size, with less information capable of being displayed on the screen.

Presently, computer display systems are capable of displaying multiple text and graphics images corresponding to different software programs simultaneously on the screen. Common examples of this are the Microsoft Windows® 95 operating system, and the Macintosh® operating system (Version 8.0, Apple Computer, Inc., Cupertino, Calif.). These systems can simultaneously display the output of multiple programs in multiple "viewing areas" on the screen. In these current systems, each software program running on the computer generates an output of display data and commands which represent values for a specific number of pixels. The operating system takes this program display data and organizes it for display (via the video controller) along with display data from other programs and the background display data of the operating system. Based on the size and position of the display viewing area for each program, the operating system determines which portion of the program's display output will be shown on the view screen. By re-sizing a display viewing area, a user can choose to display a smaller or larger portion of the total pixels output by the software program.

A user may adjust the total screen resolution (i.e. change the total number of pixels displayed). This changes the number of dots per pixel (and therefore the image sizes, the sharpness, and the total amount of information the user can see on the screen). There is presently no capability, however, for displaying different viewing areas at different resolutions. A user cannot presently choose to have two viewing areas simultaneously displayed with different values for the number of dots per pixel. Because of the sharpness/image size tradeoff, this would be a desirable feature, as a user could then display, for example, a picture file at a low number of dots per pixel, with high resolution and small image size, while simultaneously displaying a word processing program with a significant amount of text at a high number of dots per pixel, low resolution, and large image size. This would allow for a large portion of the picture to be shown on a small viewing area, with optimized appearance due to the high sharpness, while the text of the word processing program is displayed large enough to allow for easy reading and editing.

Some programs that are run on current systems were developed when display screens were capable of displaying fewer pixels than is possible today. Both dots and pixels were larger on the old display systems. Programs designed for those systems, therefore, are displayed on current high-resolution systems as smaller viewing areas. The programs output the same number of pixels as they do when run on older systems, but the number of dots per pixel has decreased (as has the size of the dots) so the same number of pixels takes up less area on the computer display screen. Current systems are not capable of increasing the size of these viewing areas without changing the dots per pixel of the entire screen. It is desirable to create a system which would appear to the user as an increase in the dots per image (or application) for such programs, while allowing other programs to be displayed at the dots per pixel value which has been selected for the rest of the screen. It is desirable, therefore, to allow the user to adjust the apparent number of dots per pixel independently for independent viewing areas. This will make it possible for it to appear to a viewer that two viewing areas of the same size are displaying different numbers of pixels.

SUMMARY OF THE INVENTION

According to an embodiment of the present invention, a video display system is provided including a first viewing area on the video display system having a first resolution, and a second viewing area on the video display system having a second resolution, where the first resolution is higher than the second resolution.

DETAILED DESCRIPTION

Figure 1:
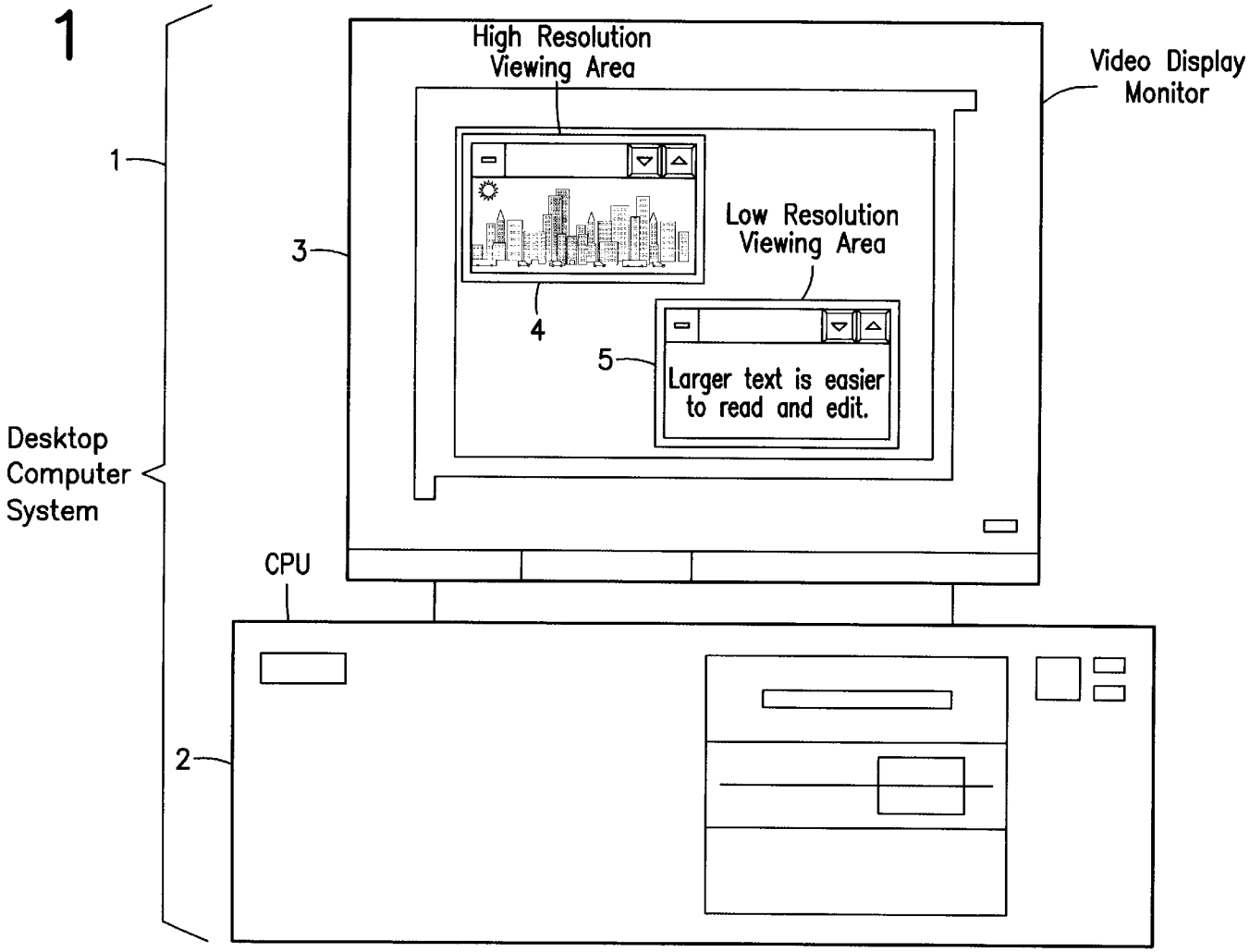
FIG. 1 is a drawing of a desktop computer system on which an embodiment of the present invention has been implemented.

Referring to FIG. 1, an embodiment of the present invention is shown, as implemented on a desktop computer system. A desktop computer system 1 includes a video display monitor 3 and a desktop computer chassis 2 including at least one processor (e.g. a Pentium® II processor, Intel Corporation, Santa Clara, Calif.), at least one bus, a storage device (e.g. disk drive) and other known elements of desktop computer systems. The video display monitor displays computer data in the form of visual images, including text. In the embodiment shown in FIG. 1, the desktop computer system 1 displays the output of programs and the contents of files in "viewing areas" 4, 5. This allows the user to view multiple programs or files simultaneously. Furthermore, the user can change the size and position of the viewing areas 4, 5 to optimize use of the system.

FIG. 1 illustrates viewing areas 4, 5 displayed at different resolutions, according to an embodiment of the invention. A high-resolution viewing area 4 is displayed at a first resolution, referred to here as a "background resolution." The background resolution is generally the highest resolution at which data is currently displayed on a monitor. The background resolution may be the resolution of one or more viewing areas, it may be the resolution of the portions of the screen not covered by viewing areas, or it may be the resolution of the entire screen. Also shown in FIG. 1 is a low-resolution viewing area 5, displayed at a second resolution, referred to here as an "apparent resolution." An apparent resolution is the resolution (dots per pixel), other than the background resolution, at which it appears to a user that data is being displayed. The apparent resolution is created with an interpolation of the background resolution into a lower resolution. The second resolution shown in FIG. 1 is referred to as an apparent resolution because it is interpolated down from the highest resolution (background resolution) to which the monitor is set for display, and is displayed in, for example a viewing area 5 on a monitor 3 that is also displaying a higher-resolution viewing area 4. Therefore, the resolution of viewing area 5 appears lower, even though the monitor 3 is capable of displaying at a higher background resolution with the current settings.

By changing the manner in which values of pixels are determined, or the number of pixels output for a particular image according to a particular interpolation scheme, it appears to a user that the resolution of the image has changed. The high-resolution viewing area 4 and the low-resolution viewing area 5 take up the same area on the screen, but since the resolution is set differently by the user, each viewing area appears to be displayed at a different resolution. The display data and commands output by the program displayed in viewing area 5 are interpolated so that more pixels are assigned to the program's image, and the portion of the image displayed in viewing area 5 (a portion of each image may be stored in memory but not displayed because of the size of the viewing area) appears to the user displayed at a lower resolution, giving the appearance of more dots per pixel. In the embodiment shown in FIG. 1, the user has chosen a higher resolution for the high-resolution viewing area 4, and a lower resolution for the low-resolution viewing area 5. The size-resolution tradeoff, therefore indicates that the graphics of the low-resolution viewing area 5 will be larger than the graphics of the high-resolution viewing area 4. Although the high-resolution viewing area 4 will display more data, the individual graphics elements of the low-resolution viewing area 5 will be larger and easier to see.

In the case of the embodiment illustrated in FIG. 1, the user has chosen to place the viewing area displaying a graphics picture in a high resolution mode. This allows the user to view a large portion of the graphics picture in the viewing area and makes the picture look more realistic because the high pixel density increases resolution. The user has simultaneously chosen to place the viewing area displaying text in a low resolution mode. While this decreases the amount of information the user can see in the viewing area, it makes the displayed text appear larger and therefore easier to read and edit. In systems not employing the present invention, the user must choose to display the entire screen at one resolution.

Figure 2:
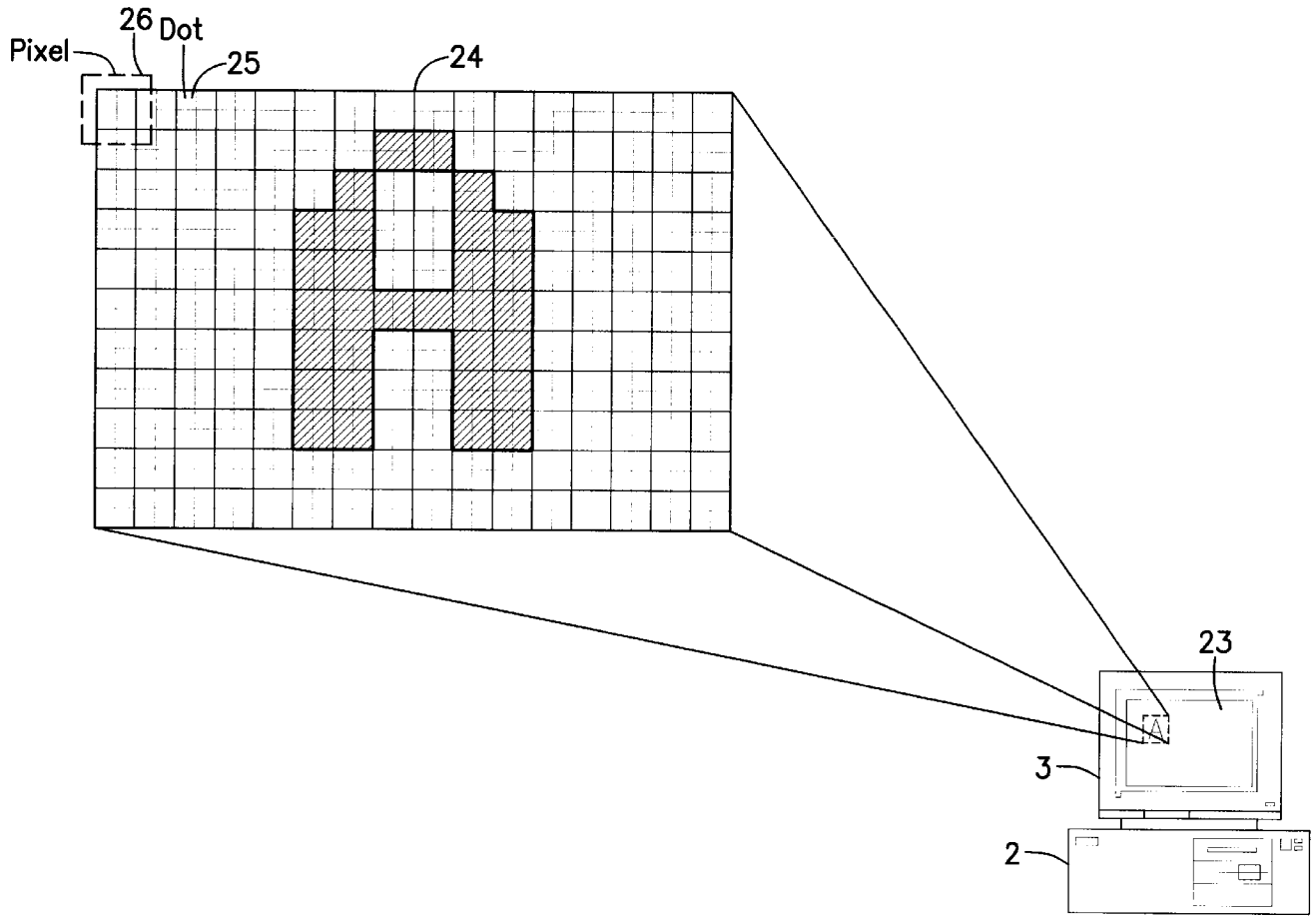
FIG. 2 is a schematic representation of a portion of a computer display screen.
Figure 3:
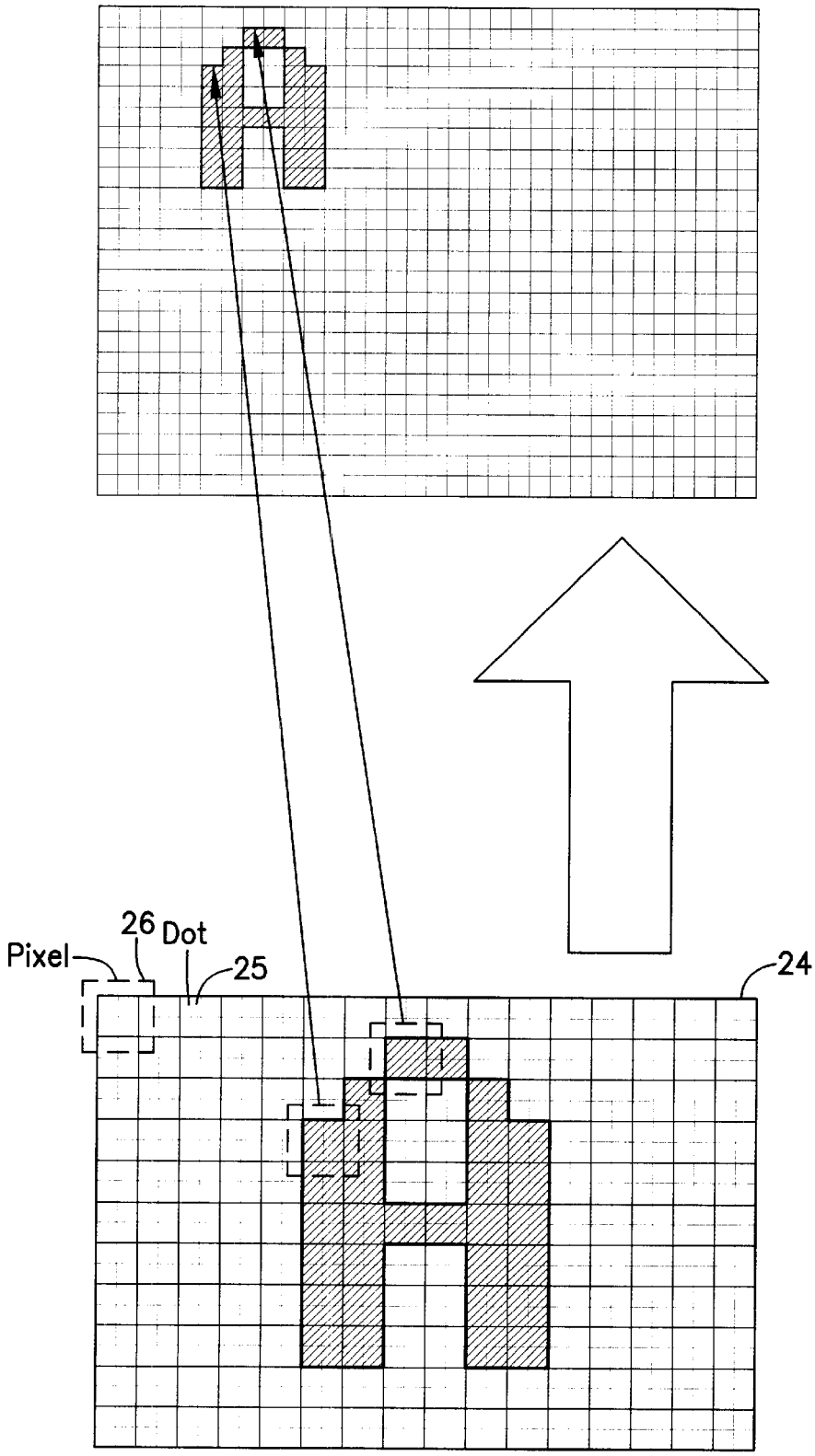
FIG. 3 is a schematic representation of the display of computer data on a portion of a computer display screen.

FIG. 2 shows a schematic drawing of a portion of a computer display screen. In the example shown in FIG. 2, a portion 24 of the screen 23 of the video display monitor 3 is shown greatly enlarged so that the individual dots 25 and pixels 26 are represented. In the example shown in FIG. 2, each pixel 26 is made up of four dots 25. Certain pixels are illuminated differently from the surrounding pixels to display the letter "A." FIG. 3 shows a schematic representation of portions of display data, as processed by a computer system, and displayed on a screen, in accordance with the prior art. Programs may be designed to operate at maximum resolutions lower than the maximum resolution of the available monitor. This may be, for example, because the program was created when maximum display resolutions were lower than the resolutions available on more modern systems. In prior art systems, programs created for lower resolutions will simply be displayed by assigning the value for each large pixel (many dots) in the old system to a small pixel (fewer dots) in the new system. This is a "one for one" adapter system, and the resulting image is therefore smaller (fewer dots) on the high-resolution screen than it was on the low-resolution screen for which the program was originally designed. In the prior art systems, this image cannot be made larger. A feature of the present invention is that programs designed for display on low-resolution systems can be displayed on high-resolution systems at their original display size, or any size in between, by altering the resolution of the program viewing area.

Figure 4:
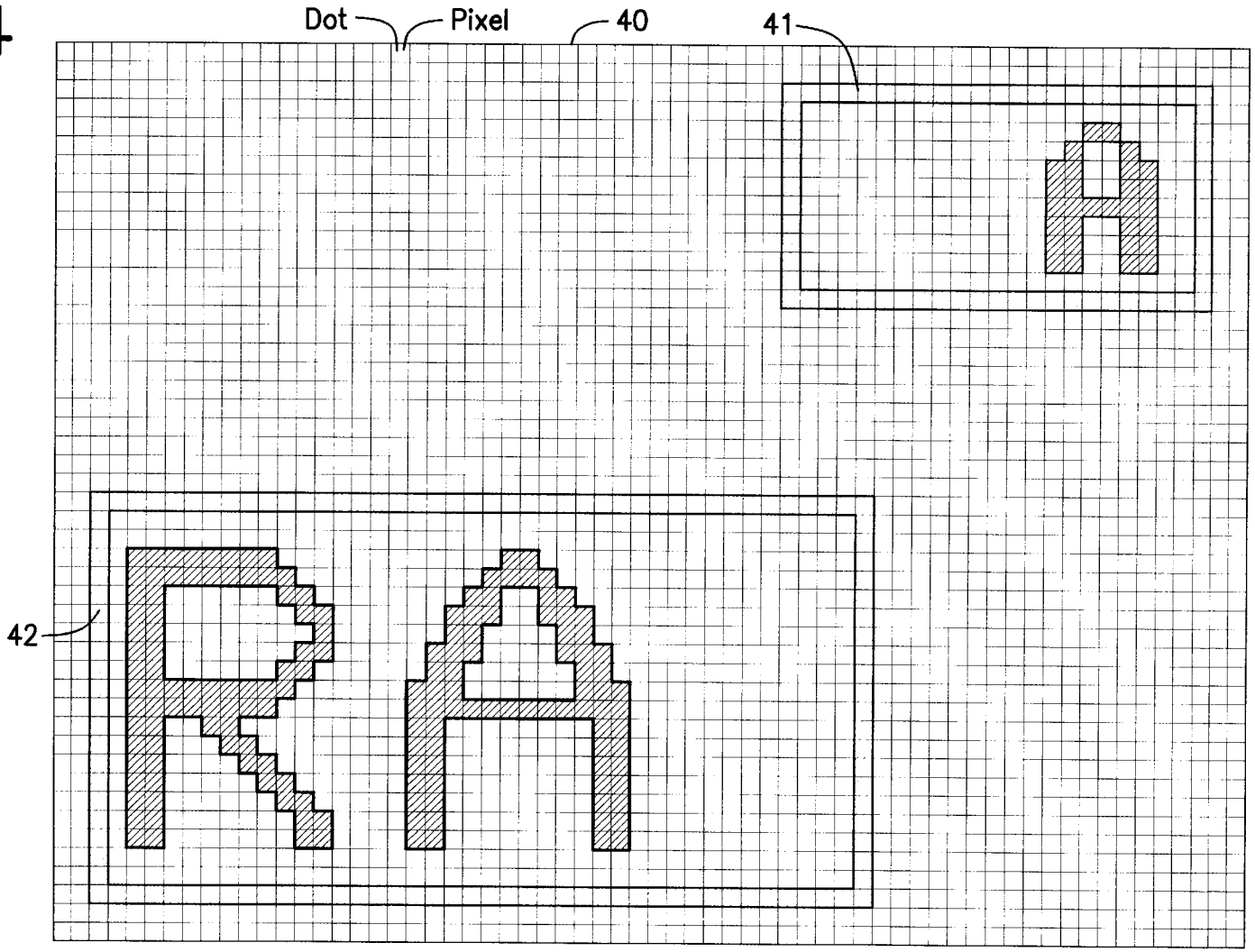
FIG. 4 is a schematic representation of the display of computer data on a portion of a computer display screen.

FIG. 4 shows a schematic representation of the output of computer data on a video display screen according to a current system. More specifically, FIG. 4 is a representation of a portion of a display screen containing computer data output by two programs at two resolutions. The first viewing area 41 shows computer data output by a program designed to run on a system with a display screen having a maximum resolution lower than the maximum resolution of the screen 40 represented in FIG. 4. The first viewing area 41 represents data displayed as described and shown in FIG. 3. Simultaneously displayed on the screen is a second viewing area 42, which displays data output by a program designed to output data for display at the resolution of the screen 40. The resolution of the screen 40 is sufficiently high that each pixel is comprised of only one dot. This screen, therefore, will have a high resolution. This high resolution of the screen 40 allows the program displaying data in the second viewing area 42 to display characters with smoother lines and more detail, as can be seen by comparing viewing area 42 with viewing area 41. Currently, it is not possible to enlarge viewing area 41, and thereby display the data larger than shown in FIG. 4. Furthermore, it is not possible to display viewing area 42 at one resolution and viewing area 41 at a different resolution simultaneously.

Figure 5:
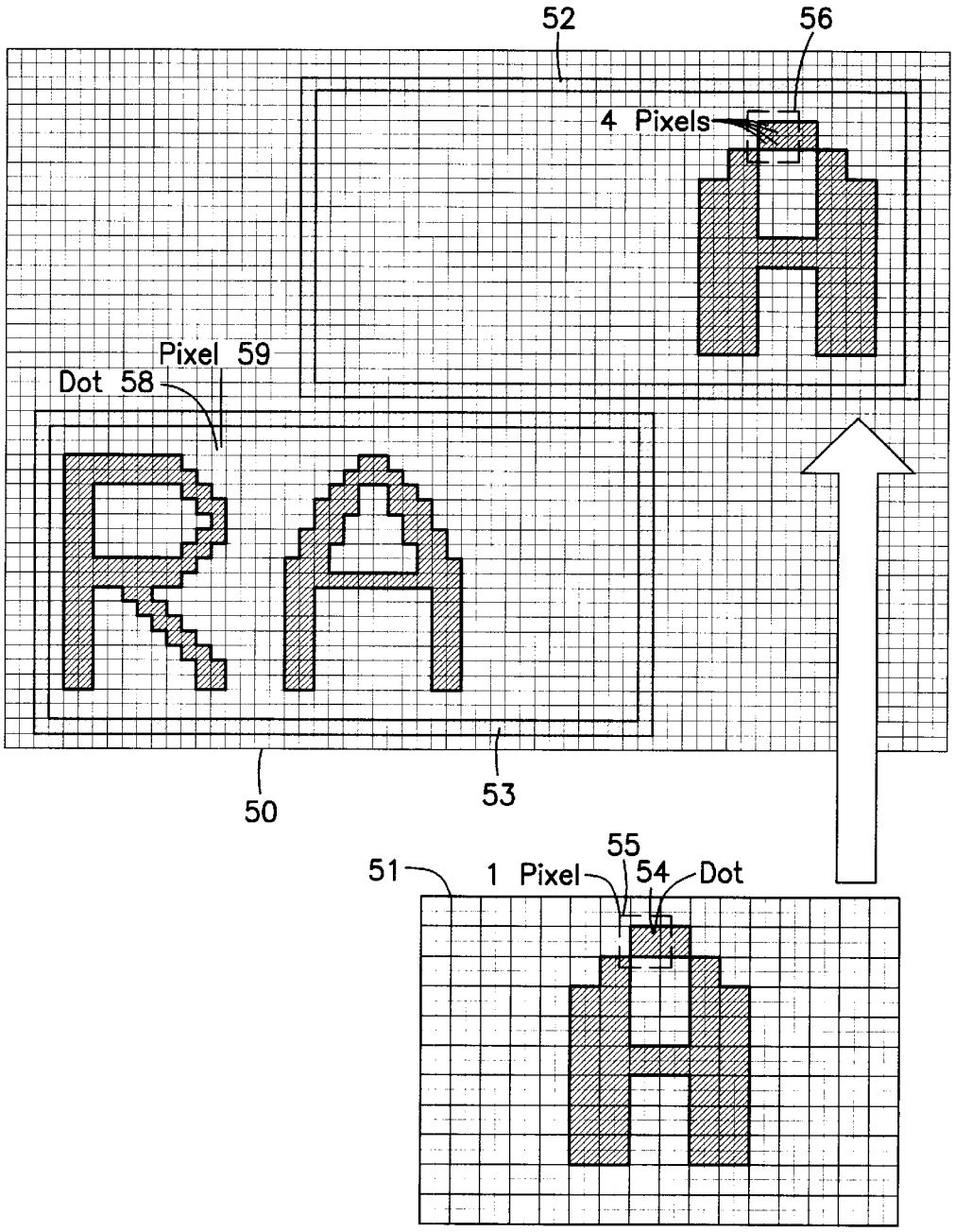
FIG. 5 is a schematic representation of the display of computer data on a portion of a computer display screen.

FIG. 5 is a schematic representation of a display screen 50 of a computer system on which an embodiment of the present invention is implemented. The display data output 51 of a program designed for a display with a maximum resolution lower than the resolution of the display screen 50 is also represented in FIG. 5. The display data 51 is represented as it would be displayed on a low-resolution screen, with four dots 54, per pixel 55. The resolution of the screen 50 is one dot 58 per pixel 59. The display data 51 is displayed on the display screen 50 in the viewing area 52 at an apparent low-level resolution matching the resolution at which the program was designed to be displayed. The data appears larger than the same data displayed in a current system, shown in FIG. 4, because each pixel 55 of display data 51 is interpolated into four pixels 56 (each comprising one dot 58) when the pixel 55 is displayed on screen 50. A second viewing area 53 displays data output by a program designed to display data at the resolution of the screen 50 (background resolution) represented in FIG. 5. The data displayed in viewing area 53 is able to be displayed with more definition and resolution than the data displayed in the first viewing area 52.

Figure 6:
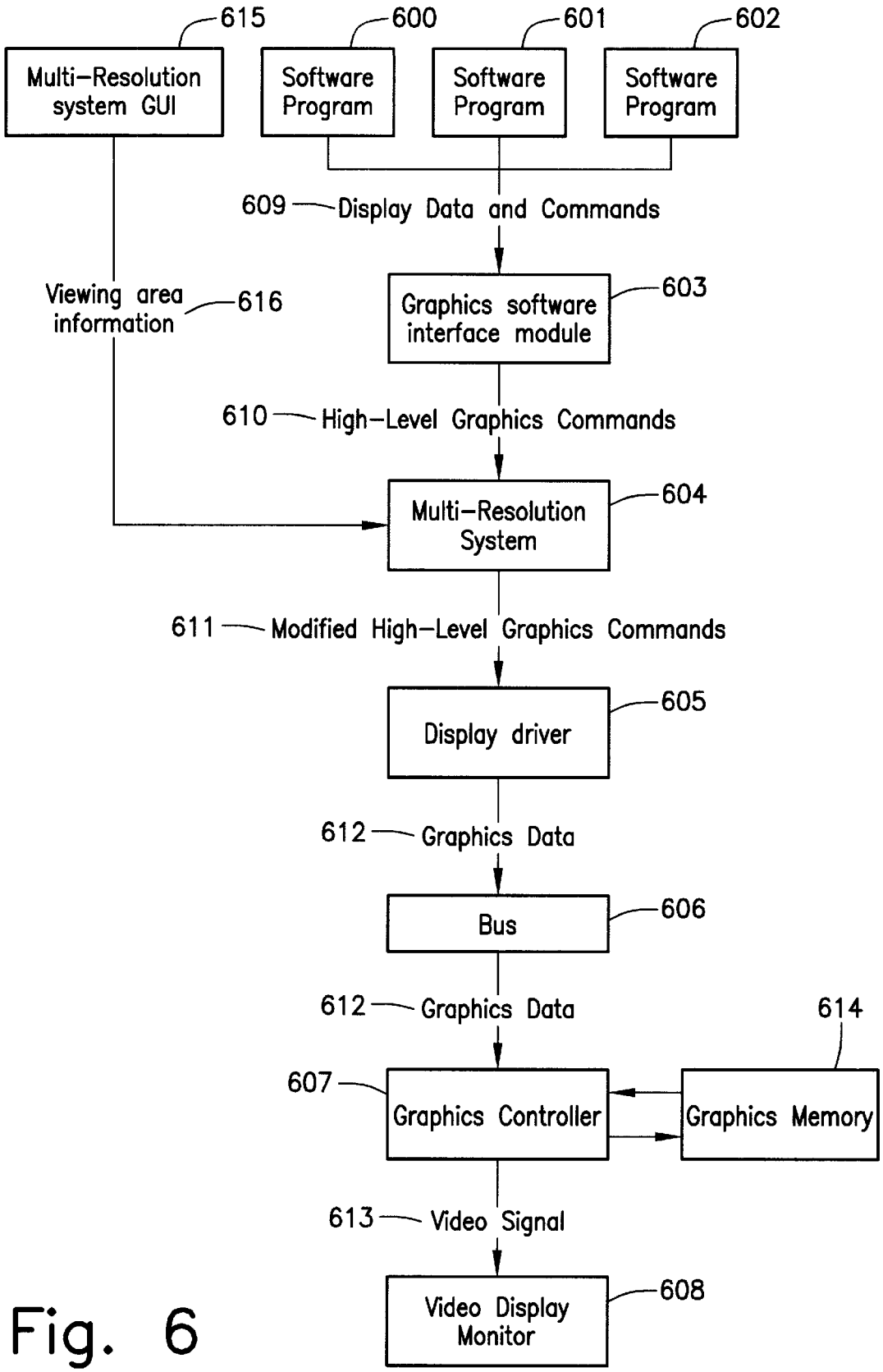
FIG. 6 is a logical block diagram of an embodiment of the present invention.

FIG. 6 shows a logical block diagram of an embodiment of the present invention implemented on a particular computer system whereby, for example, the display illustrated in FIG. 5 is created. Various software programs running on a computer system are shown as 600, 601, and 602 in the exemplary embodiment of FIG. 6. A viewing area is open to display the graphic output of each software program. Each software program 600, 601, 602 outputs display data and commands 609 to the computer system's graphics software interface module 603. An example of a graphics software interface module 603 is the Graphics Display Interface (GDI) software module for the Microsoft Windows®95 operating system.

The graphics software interface module 603 converts the display data and commands 609 into high-level graphics commands 610 which the display driver 605 can understand. The high-level graphics commands 610 are basic instructions to the graphics controller for creating the desired images on the screen (e.g. bit block transfers, drawing commands, and viewing area commands). These steps are known and used in present computer systems. The multi-resolution system 604 interprets the high-level graphics commands 610 and modifies them to adjust the apparent resolution of the output of programs for which the user has selected a resolution other than the background resolution. This is done through an interpolation method shown in FIG. 8. The user previously selected the apparent resolution via the multi-resolution system's Graphics User Interface (GUI) 615. Along with the user's selected apparent resolution, the multi-resolution system GUI 615 provides viewing area information 616 to the multi-resolution system 604 during user selection. This viewing area information 616 is used to determine what graphics information needs to be altered and how it is to be altered to achieve the user-selected apparent resolution.

The multi-resolution system module 604 then forwards the modified high-level graphics commands 611 to the display driver 605 provided by the video board manufacturer or the operating system. The display driver 605 initiates the exchange of graphics data 612 with the graphics controller 607 through a bus 606 (e.g. the I/O bus, the local bus). The display driver 605 processes the modified high-level graphics commands 611 to create the graphics data 612, which it sends to the graphics controller 607 through the bus 606. The graphics controller 607 receives graphics data 612 from the display driver 605 and converts it to a video signal 613 used to control the video display monitor 608. The graphics controller 607 is also in communication with a graphics memory 614.

Figure 7:
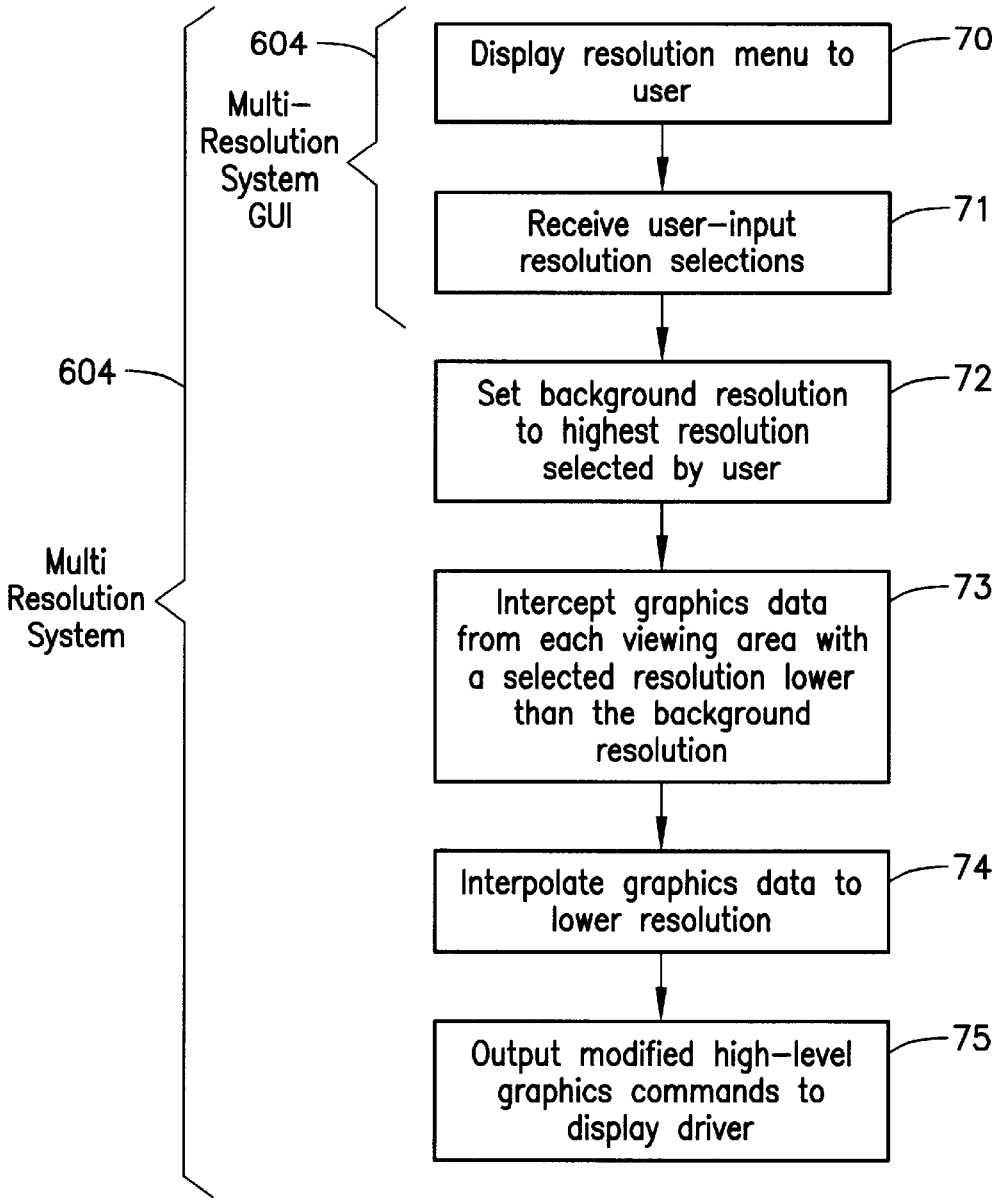
FIG. 7 is a flow diagram of an embodiment of a method implemented by a component shown in FIG. 6.

An embodiment of the method implemented by the multi-resolution system 604 is shown in detail in the flow chart of FIG. 7. When the multi-resolution system 604 is initiated (this can be, e.g. automatic on start-up, or following a user selection), a menu is displayed to the user in step 70 through the multi-resolution system GUI 615. This menu is designed to allow the user to choose the resolution at which each viewing area should be displayed, as well as the background resolution of the monitor. In step 71, the user inputs the desired resolutions for each viewing area through the multi-resolution system GUI 615. The multi-resolution system 604 then operates on the video driver software and the graphics controller to place the entire monitor in the highest of the resolutions selected by the user (step 72). This becomes the "background resolution" of the monitor. In step 73, the multi-resolution system 604 intercepts the high-level graphics commands 610 output by the operating system's graphics software interface module 603. This is accomplished by inserting the multi-resolution system 604 as a display driver, between the graphics software interface module 603 and the true display driver 605. The multi-resolution system 604 then calls the true display driver after it is finished processing. In this way the multi-resolution system 604 can analyze and manipulate the high-level graphics commands 610 and pass the result on to the true display driver 605, acting as a filter. This result is in the form of modified high-level graphics commands 611, which describe the graphics to be displayed on the video monitor. These modified high-level graphics commands 611 will be processed by the display driver into graphics data 612 and then by the graphics controller 607 to construct a screen data table.

Figure 8:
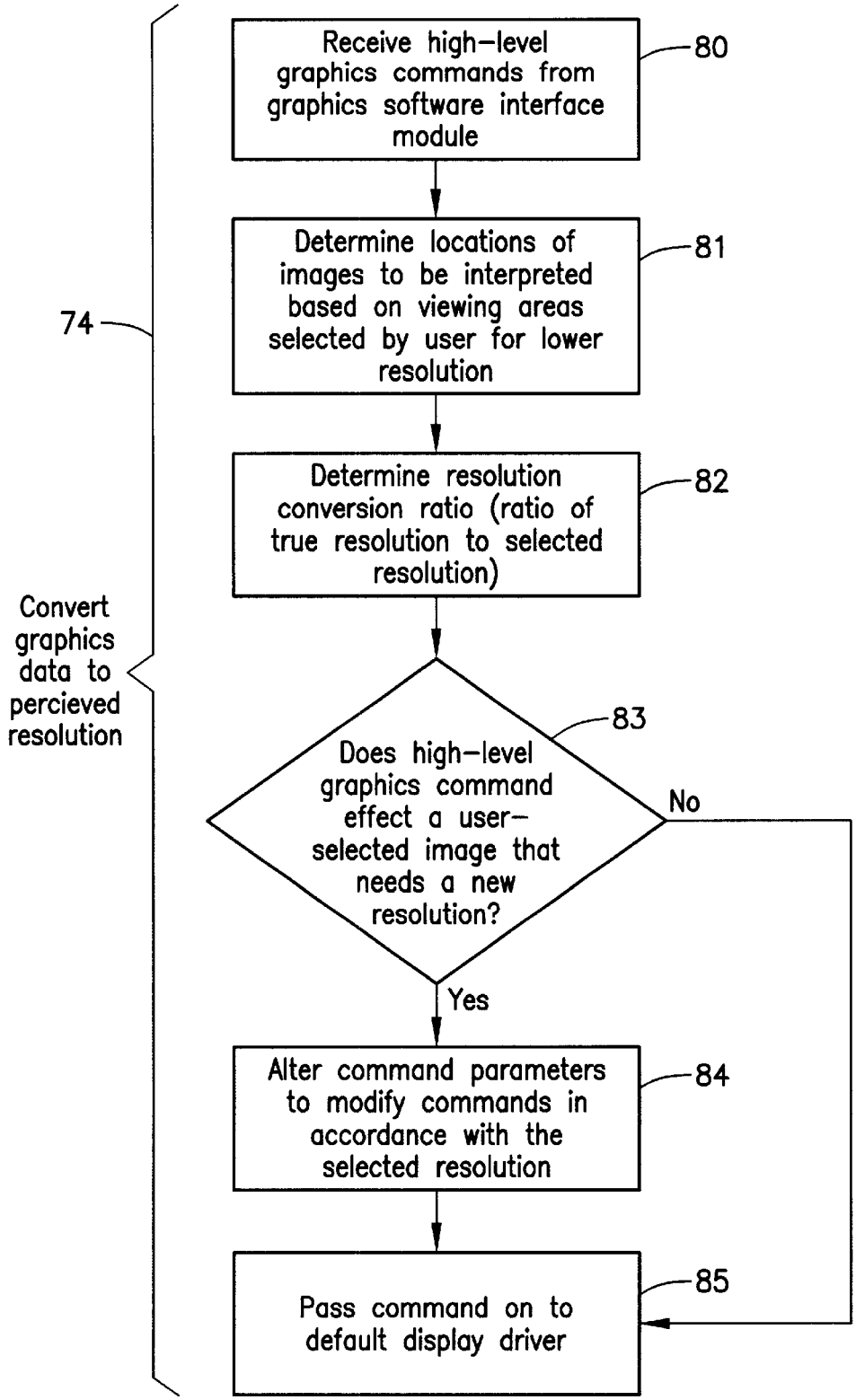
FIG. 8 is a flow chart of an embodiment of a method implemented by a step shown in FIG. 7.

In step 74, the intercepted high-level graphics commands 610 are interpolated to the desired resolution selected by the user by performing the following steps, shown in detail in the flow chart of FIG. 8. In FIG. 8, an embodiment of the process for interpolating a high-level graphics command 610 to the desired resolution according to the present invention is shown. The process of FIG. 8 is performed on each high-level graphics command that is intercepted from the graphics software interface module 603 by the multi-resolution system 604. High-level graphics commands 610 are interpolated into modified high-level graphics commands 611. In step 80, the high-level graphics commands 610 are received from the graphics software interface module 603. The multi-resolution system 604 exposes the same interface as the true display driver 605 would. In step 81, the multi-resolution system 604 retrieves the list of viewing areas which must have their resolutions changed and determines from that list the images that must be interpreted into lower resolutions, and the pixels outside those viewing areas that may be affected. The information retrieved is the viewing area locations and the individual resolution changes. In step 82, the multi-resolution system 604 determines a resolution conversion ratio. This is the ratio of the background resolution to the resolution selected by the user. The resolution conversion ratio is used to interpolate the high-level graphics commands 610 into the selected resolution. In step 83, the high-level graphics command is checked to determine if it affects any of the viewing areas (e.g. user-defined screen regions or application viewing areas) with resolution changes. If none of the viewing areas are affected, the graphics command is passed on to the default display driver to be handled normally in step 85.

If a viewing area is affected, then the high-level graphics command will be modified so that the graphic represented by that command will be displayed at the user-selected apparent resolution. A two-part resolution conversion ratio will be calculated for performing the interpolation of affected graphics commands. The ratio of the number of horizontal pixels in the background resolution to the number of horizontal pixels in the apparent resolution (if the entire screen were displayed in that resolution) is calculated for the first part of the resolution conversion ratio, and the ratio between the number of vertical pixels in the background resolution and the number of vertical pixels in the apparent resolution is calculated for the second part of the resolution conversion ratio. The resolution conversion ratio may contain both a vertical and horizontal component because the user-selected apparent resolution can be any resolution and does not have to correspond to a standard display resolution and does not have to have the same vertical/horizontal pixel ratio as the background resolution. To calculate the new graphics command, the horizontal and vertical components of the resolution conversion ratio are multiplied by the horizontal and vertical components of the graphics command. Any commands that interpolate to cover screen points outside the viewing area selected for a resolution change are cropped, and the default commands for those areas are still used.

A simplified example will illustrate how this interpolation is performed. For example, a graphics command to be interpolated could be a line command containing the following instruction: start at point (pixels) (X, Y) and draw a horizontal line L pixels long and W pixels thick. To make the example more concrete, suppose the following values for variables: X=100, Y=100, L=10, W=2. That is, the graphics command to be interpolated is a command to start at pixel (100, 100) and draw a horizontal line 10 pixels long and 2 pixels wide. If the background resolution of the system is 1024 by 768 pixels, let P=1024 and Q=768. If the user-selected apparent resolution is, for example, 640 by 480 pixels, let R=640 and S=480. In this case the resolution conversion ration would be P/R, Q/S, or (1.6, 1.6) for the current example.

To calculate the new graphics command, the resolution conversion ratio is multiplied by both the line dimensions and the starting location to obtain new values as follows. The new starting position is (X*P/R, W*Q/S)=(100*1.6, 100*1.6)=(160, 160). The new horizontal length is (Y*P/R)=(10*1.6)=16, and the new vertical width is (W*Q/S)=(2*1.6)=3.2 [round up to nearest integer value]=4. The new interpolated graphics command is the following: start at pixel (160, 160) and draw a horizontal line 16 pixels long and 4 pixels wide. This example provides a simple illustration of a method for interpolating a graphics command. For the sake of clarity, a particularly simple example was chosen, however, it should be understood that other interpolation methods are within the scope of the invention. This includes alternative methods of calculating a resolution conversion ratio, and applying that ratio to perform the required interpolation. Also included are more sophisticated algorithms including, for example, algorithms for smoothing of curved lines in interpolated images.

In step 84, the command parameters are altered according to the resolution conversion ratio. This may be accomplished, for example, by replacing the original high-level graphics command 610 with a single modified high-level command 611, the parameters of which are calculated as described above. Alternatively, the original command may be replaced with multiple commands, or commands may be forwarded in addition to the original command which accomplish the same displayed result as the replacement command described above. In an alternative embodiment of the present invention, a scaling function may be performed for step 84 in which the graphics memory is changed directly. The particular architecture of the system on which the multi-resolution system is running may determine which of these embodiments of step 84 is implemented.

Referring again to FIG. 7, in step 75, the modified high-level graphics commands 611 are output to the true display driver 605. The modified high-level graphics commands 611 are then processed by the display driver 605, as in a system not containing a multi-resolution system, and the resulting graphics data 612 is output to the graphics controller 607, and then to the video monitor 608 in the form of a video signal.

Although an embodiment is specifically illustrated and described herein, it will be appreciated that modifications and variations of the present invention are covered by the above teachings and within the purview of the appended claims without departing from the spirit and intended scope of the invention. Specifically, although a method is described as implemented through the use of software modules, it is to be understood that a hardware implementation of the above-described method and apparatus is within the scope of the invention.

What is claimed is:

1. A video display system comprising:

a multi-resolution system;

a display driver; and a video display monitor, wherein:

the video display system receives an input;

the multi-resolution system calculates a resolution conversion ratio as a function of the input;

a high-level graphics command is sent to the multi-resolution system;

the multi-resolution system uses the resolution conversion ratio to modify the high level graphics command to create a modified high-level graphics command;

the modified high-level graphics command is sent to the display driver;

the modified high-level graphics command is used to control an output of the video display monitor.

2. The video display system of claim 1, wherein:

the input is a desired apparent resolution selected by a user.

3. The video display system of claim 1 wherein the multi-resolution system intercepts the high-level graphics command sent to the display driver.

4. The video display system of claim 3 wherein the multi-resolution system mimics the display driver.

5. The video display system of claim 1 wherein the multi-resolution system modifies the high-level graphics command, based on a desired apparent resolution, by substituting a new graphics command for the high-level graphics command.

6. The video display system of claim 1 wherein the multi-resolution system modifies the high-level graphics command, based on the desired apparent resolution, by creating at least one new graphics command;

sending the high-level graphics command to the display driver; and sending the new graphics command to the display driver.

7. The video display system of claim 1 wherein:

the resolution conversion ratio includes a background resolution and a desired apparent resolution.

8. A method for displaying computer data on a display monitor at an apparent resolution comprising the steps of:

intercepting a high-level graphics command with a multi-resolution system;

calculating a resolution conversion ratio based on the apparent resolution;

modifying the high-level graphics command to create a modified high-level graphics command; and sending the modified high-level graphics command to a display driver.

9. The method of claim 8, wherein the step of modifying the high-level graphics command to create a modified high-level graphics command, further comprises:

if the high-level graphics command affects an image to be displayed at the apparent resolution, using the resolution conversion ratio to alter a parameter of the high-level graphics command.

10. The method of claim 8, further comprising the step of:

setting a background resolution to the maximum resolution at which data is to be displayed.

11. A set of instructions residing in a storage medium, said set of instructions capable of being executed by a processor to implement a method for displaying computer data on a display monitor at an apparent resolution, the method comprising the steps of:

intercepting a high-level graphics command with a multi-resolution system;

calculating a resolution conversion ratio based on the apparent resolution;

modifying the high-level graphics command to create a modified high-level graphics command; and sending the modified high-level graphics command to a display driver.

12. A set of instructions residing in a storage medium of claim 11, said set of instructions capable of being executed by a processor to implement a method for displaying computer data on a display monitor at an apparent resolution, the method further comprising:

if the high-level graphics command affects an image to be displayed at the apparent resolution, using the resolution conversion ratio to alter a parameter of the high-level graphics command.

* * * * *